US005489228A

United States Patent [19]

Richardson et al.

[11] Patent Number: 5,489,228

[45] Date of Patent: Feb. 6, 1996

[54] WATER SPORTS BOARD

[76] Inventors: James Richardson, 67-003 Kaimanu Pl., Waialua, Hi. 96791; Michael A. Zeh, 111 Eastgate, Santa Cruz, Calif. 95062

[21] Appl. No.: 426,636

[22] Filed: Apr. 21, 1995

Related U.S. Application Data

[63] Continuation of Ser. No. 113,230, Aug. 27, 1993, abandoned.

[51] Int. Cl.[6] ..... B63B 35/79

[52] U.S. Cl. ..... 441/74; 114/357

[58] Field of Search ..... 114/357, 39.2; 441/74, 65; 428/116–118, 69, 71, 73, 76

[56] References Cited

U.S. PATENT DOCUMENTS

| | | | |
|---|---|---|---|
| 3,514,798 | 6/1970 | Ellis | 9/310 |
| 3,543,315 | 12/1970 | Hoffman | 9/310 |
| 3,902,207 | 8/1975 | Tinkler | 9/310 |
| 3,998,794 | 11/1976 | Tinkler | 9/310 |
| 4,042,238 | 8/1977 | Theriault | 428/116 |
| 4,129,911 | 12/1978 | McDonald | 9/310 |
| 4,209,867 | 7/1980 | Abrams, III | 9/310 |
| 4,357,013 | 11/1982 | Fernandez et al. | 273/73 C |
| 4,649,847 | 3/1987 | Tinkler | 114/39 |
| 4,753,836 | 6/1988 | Mizell | 428/71 |
| 4,797,312 | 1/1989 | Sherwood | 428/117 |
| 4,797,549 | 1/1989 | Hirsch | 441/74 |
| 4,836,814 | 6/1989 | Bambara | 441/65 |
| 4,887,986 | 12/1989 | Langenbach | 441/74 |
| 4,945,846 | 8/1990 | Miley | 114/39.2 |
| 4,961,715 | 10/1990 | Shanelec | 441/74 |
| 4,963,111 | 10/1990 | Moulin | 441/74 |
| 5,114,370 | 5/1992 | Moran | 441/65 |

FOREIGN PATENT DOCUMENTS

| | | | |
|---|---|---|---|
| 3020344 | 12/1981 | Germany | 441/74 |
| 3149534 | 7/1983 | Germany | 441/74 |
| 3406689 | 8/1985 | Germany | 114/39.2 |
| 3537703 | 5/1987 | Germany | 441/74 |

*Primary Examiner*—Edwin L. Swinehart
*Attorney, Agent, or Firm*—Seth M. Reiss

[57] ABSTRACT

An improved water sports board having a low density high strength elongated core surrounded by a contoured exterior layer formed of soft resilient non-permeable material. The elongated core, substantially rectangular in plan shape and cross-section, tapering forward and aft, and constructed of low density light weight material covered by a high-strength composite skin, renders the board light and strong, and promotes controlled flexion, resilience, durability and maneuverability. The soft, resilient exterior layer forms the board's outer shape, promoting performance and rendering the board safe and comfortable to ride. Alternative embodiments in which the core contains of one or more cavities filled with gas, the pressure of which gas can be selectively varied before or during use, are also described.

22 Claims, 9 Drawing Sheets

WATER SPORTS BOARD

This application is a continuation of application Ser. No. 08/113,230 filed on Aug. 27, 1993 now abandoned.

BACKGROUND OF INVENTION

1. Field of Invention

The present invention relates to water sports boards including surfboards, body boards and sail boards. More particularly, this invention describes water sports boards having an improved construction rendering them light, strong and durable, while at the same time more versatile and safer than currently available water sports boards.

2. Description of the Prior Art

Board-shaped riding vehicles have long been a part of water recreation, first as surfboards, and later as sail boards (sometimes referred to as windsurf boards) and body boards (also known as boogie boards). Surfboards were traditionally stiff and heavy, with hard exterior surfaces. In recent years, surf and sail board manufacturers have utilized synthetic materials to make light weight boards. Body boards are normally constructed from soft foam materials.

Whereas the technique of using synthetic materials to make light weight boards is now well known and understood, presently available light weight boards tend to be stiff, fragile and expensive. The hard outer skin encountered on conventional surf and windsurf boards resist flexing, causing the lightweight boards to break down rapidly under the repeated bending and twisting forces encountered in water sports. A primary object of the present invention is to provide a water sports board that is very light and at the same time strong and durable.

Most available body boards have a continuous structure formed from a soft foam product. The soft feature of the body boards makes them safe and comfortable to use, but lacks the stiffness necessary to enable the boards to withstand intense forces encountered in surfing and board sailing. A further objective of the present invention is to provide a water sports board having the strength and stiffness necessary to counteract the intense forces encountered in surfing and board sailing and, at the same time, a soft exterior rendering the boards comfortable to ride, safer to use, and more durable.

Currently available surf and sail boards generally have light density cores covered by a hard brittle skin. The resulting boards are light weight but substantially rigid. Substantially rigid boards are fragile, they have limited maneuverability, and are less versatile compared with flexible water sports boards. Substantially flexible boards, like boogie boards, fail to perform under the more significant forces encountered in many water sports. A third objective of the present invention is to provide a water sports board which allows for controlled or limited flexibility. The flexibility promotes maneuverability, but because the flexibility is controlled, the board maintains its designed form under significant pressure and after multiple uses.

SUMMARY OF INVENTION

This and other objects are accomplished in the present invention, an improved water sports board comprising a low density high strength elongated box-shaped core surrounded by a contoured soft foam exterior layer having a smooth outer surface.

The low density high strength core renders the board light, strong and durable. It is composed of extruded polystyrene foam, expanded polystyrene foam beads, or other suitable low density material surrounded and strengthened by a high strength composite skin.

According to one embodiment, the low density core material exhibits a honey-comb architecture with the combined characteristics of lightness and strength. According to another embodiment, the low density core material is pressurized low density gas enclosed in bladders. Low density gasses, such as helium gas, partially displace the weight of the board and its rider. Having the gas under pressure assists to maintain the board's structural integrity, withstanding pressures encountered in surfing and board sailing. The pressure of the gas in the core can be made adjustable enabling the user to vary the stiffness of the board before and during use.

The high strength composite skin which surrounds the low density core material endows the board with its strength and durability. The skin is fabricated from carbon, glass, or polymeric fiber, layered with epoxy or other resin. The composite skin may be reinforced in skeletal fashion using high strength material such as composite tape strips placed along the top and bottom surfaces and sides of the core. The reinforcing strips are placed in specific configurations lending the board additional strength and promoting selective flexibility.

The low density core material combines with the high strength composite skin in rectangular configuration to form a board having a torsion box frame. Like a snow ski, the torsion box frame permits the board limited longitudinal and torsional flexion causing the board to bend and twist in response to water forces and forces applied by the rider. The core construction also allows the board to resume and maintain its designed form after the forces are withdrawn, even under harsh conditions and repeated uses.

The strength and flexibility of the board is varied by varying the relative thickness of the low density core and high strength composite skin. For very high strength boards, the core is comprised of layers of low density material and high strength composite skin in a sandwich configuration, or is reinforced through the use of stringers (vertically oriented ribs which run the length of the board).

The soft exterior layer is composed of polyethylene foam or other suitable non-absorbent soft and resilient material. While the elongated box-shaped core is designed to promote strength and controlled flexion, the soft foam exterior is distributed about the core to promote buoyancy and board performance. The soft exterior layer also promotes board comfort, safety and durability to impact.

A plastic film or flexible smooth coating may be added to the outside of the soft exterior layer of the board to increase abrasion resistance and decrease friction between the board and the water.

All the above described embodiments can be fitted with fins, fin boxes and mast steps or tracks to facilitate the board's use in water sports. Fins, fin boxes and mast steps or tracks are affixed through the soft flexible exterior layer onto or into the composite skin.

Fabrication of the improved water sports board is accomplished by employing known construction techniques in new combinations and sequences. For low volume production, the improved board may be fabricated manually: the low density core is shaped by hand, the composite skin may be cured using known lay-up techniques, the soft foam exterior is laminated to the core and shaped by hand, and the finish coat painted on.

For high volume board production, the core material and skin may compression molded or formed using filament winding techniques, and the soft foam exterior layer compression molded around the core or expanded to fill a mold around the core. Final shaping of the foam exterior can be accomplished though the use of computer controlled numerical milling machines.

Alternative combinations and sequences of the above fabrication techniques may be employed, and the above techniques can be combined with other known surfboards sail board and boogie board fabrication methods, without departing from the scope and intent of this invention.

Further objects and advantages of the present invention will become apparent from consideration of the drawings and ensuing description.

BRIEF DESCRIPTION OF THE DRAWINGS

The details of typical, but not limiting, embodiments of the present invention will be described in connection with the accompanying drawings. In the drawings, closely related figures have the same number but different alphabetical suffixes.

REFERENCE NUMBERS IN DRAWINGS

Figure 1:
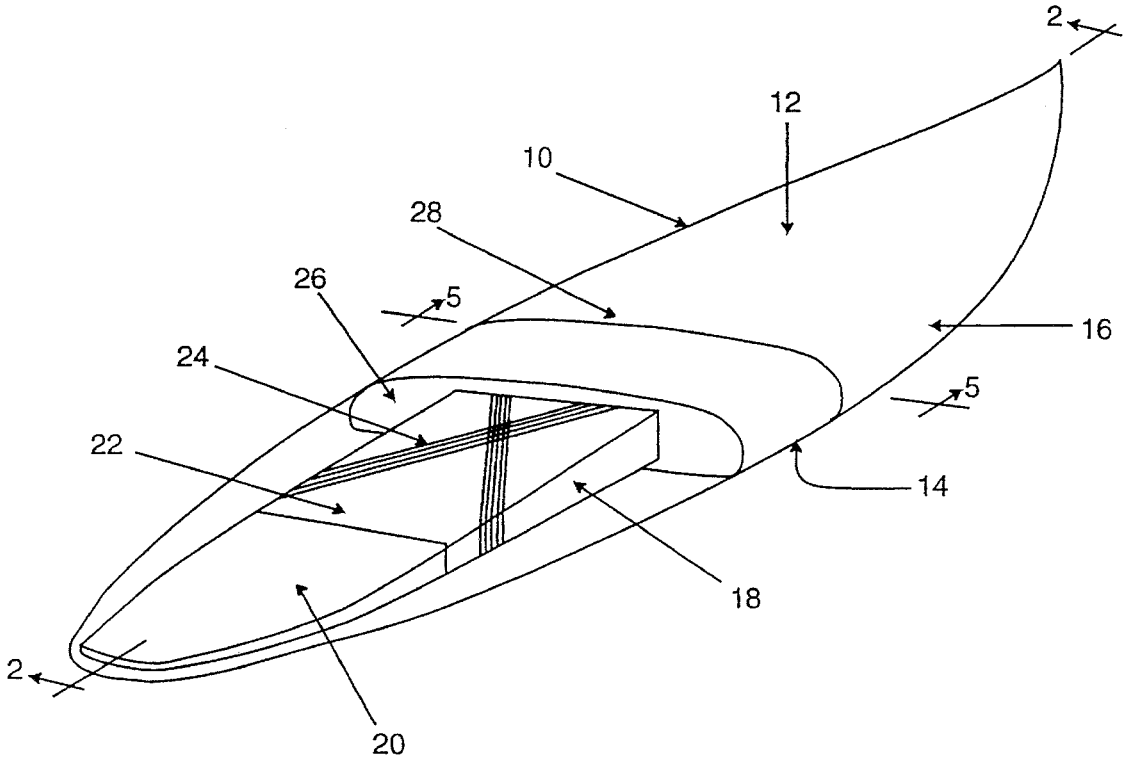
FIG. 1 is a perspective view of the improved water sports board with parts broken away.

10: hull
12: top surface
14: bottom surface
16: rail
18: elongated core
20: core material
22: composite skin
24: reinforcing strips
26: soft foam exterior
28: plastic coating
30: angle formed by reinforcing strips
32: stringer
34: nose
36: honey-comb core
38: core chamber
40: bladder
42: gas
44: valve
46: valve/pump
48: fin
50: fin box
52: mast track
54: mast

DETAILED DESCRIPTION OF THE PREFERRED EMBODIMENTS

The improved water sports board is illustrated in FIG. 1, in cut away fashion, comprising a gently contoured elongated board shaped hull 10, having a top surface 12, a bottom surface 14, and edges, known in the industry as rails, 16.

At the center of hull 10 is an elongated an elongated core 18, substantially rectangular in plan shape and cross-section, tapering forward and aft, filled with light weight, low density core material 20. Core material 20 is surrounded by a skin 22 fabricated from a high strength composite. Composite skin 22 is reinforced in skeletal fashion with strips 24 of high strength unidirectional fiber material. Surrounding skin 22 is a contoured exterior layer 26 made of a soft, resilient, and non-absorbent foam. Finally, exterior layer 26 is covered with a smooth plastic coating 28 designed to reduce resistance between the board's outer surface and the water.

Core material 20 may be composed of extruded polystyrene foam, expanded polystyrene foam beads, polyurethane foam, rigid polyvinylchloride foam, or similar material having the necessary characteristics of light weight and low density. Composite skin 22 is fabricated from a resin/fiber matrix. Appropriate resins include epoxies, polyesters, vinylesters, or other semi-rigid plastics. Fibers to complete the composite may include glass, carbon, boron carbides beryllium, polymerics, or other high strength material having a woven or unidirectional form.

Composite skin 22 can be molded around core material 20 after core material 20 has been pre-formed in box-shaped form. Alternatively skin 22 can be constructed first in box-shaped configuration, filled with core 20 materials and then sealed.

Soft exterior layer 26 is composed of polyethylene or polypropylene foam or other suitable non-permeable low density soft and resilient material. Layer 26 is affixed to skin 22 using heat or water-proof adhesive.

Core 18 with its substantially box-shaped configuration and composite construction endows hull 10 with the important characteristics of controlled longitudinal and torsional flexibility. The limited flexibility allows hull 10 to bend and twist in response to forces applied by the rider and the water, and by the wind in the case of board sailing. The construction of core 18 also allows hull 10 to quickly resume its original form once the force is removed, and to undergo significant and repeated bending and flexing without compromising or degrading the integrity of hull 10.

Figure 2:
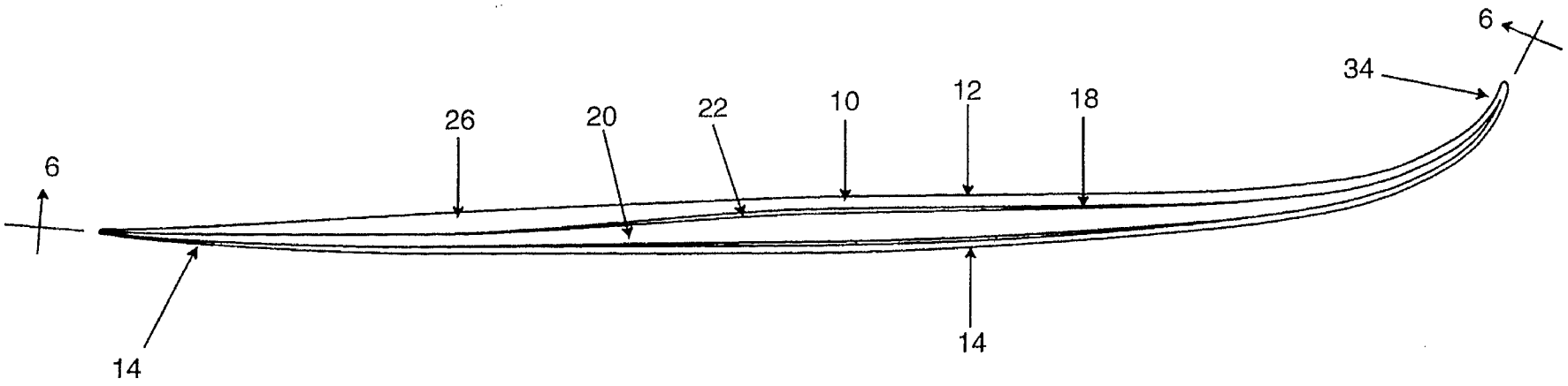
FIG. 2 is a side cross-sectional view of the improved water sports board taken on line 2—2 of FIG. 1.

Although core 18 is substantially rectangular in plan shape and in cross section, the dimensions of core 18 and the relative thickness of composite skin 22 can be varied in order to vary the quality and quantity of flexibility in hull 10. As illustrated in FIG. 2, a longitudinal cross-section taken on line 2—2 of FIG. 1, core 18 exhibits a tapered form forward and aft and skin 22 is formed more thickly around the board's middle section. This construction promotes flexibility within the board's forward and rear sections. The flexible front section dampens the effects of the board hitting chop or rough water. The flexible rear section promotes maneuverability through a combination of twisting and bending of hull 10. The less flexible middle section retains a flatter curvature for maintaining forward momentum and facilitating planing activities.

Figure 3:
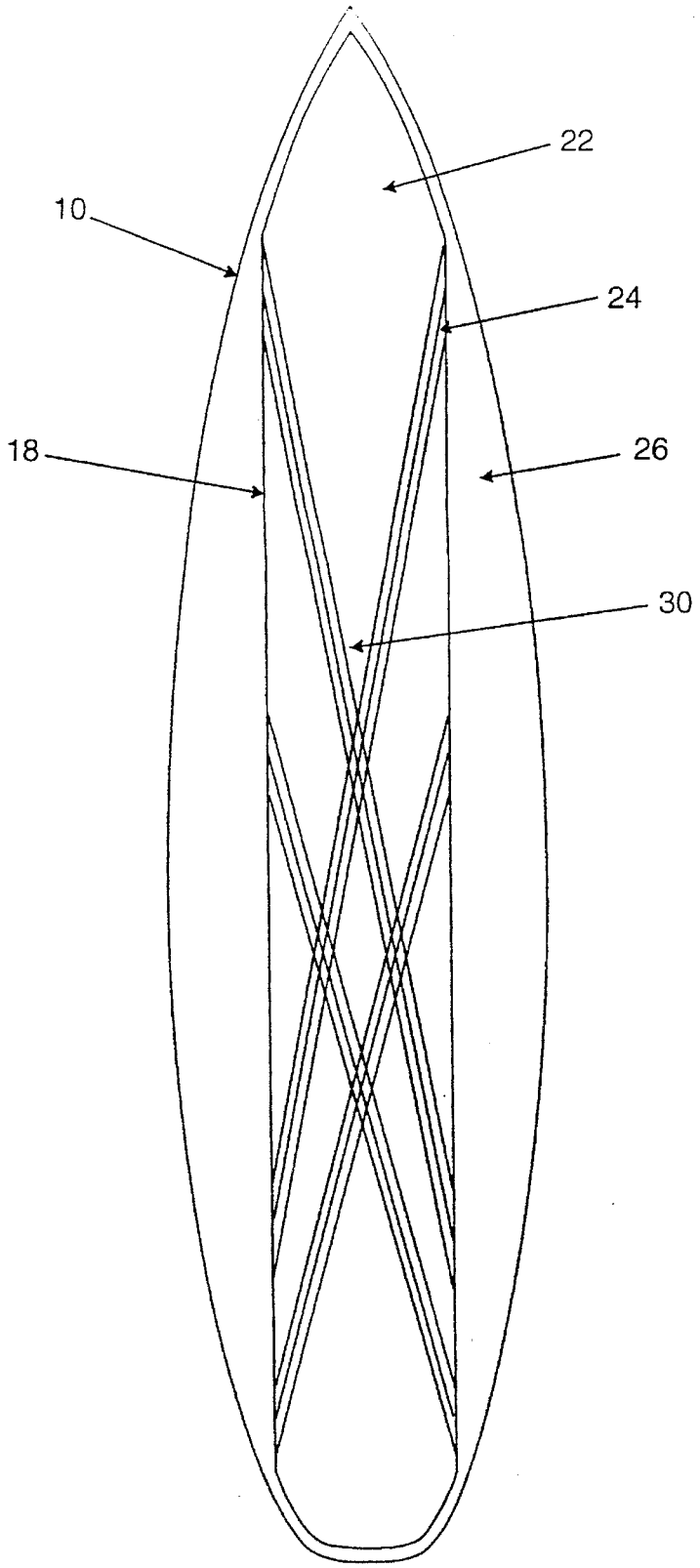
FIG. 3 is a top view of the composite skin covering the core of the improved water sports board illustrating placement of reinforcing composite strips.

The manner of reinforcing composite skin 22 using high strength strips 24 is depicted in FIG. 3. Strips 24 are wrapped in skeletal fashion around the top and bottom surfaces and sides of core 18. Strips 24 may be composed of unidirectional carbon or carbon/glass fiber and may conveniently take the form of carbon/glass tape strips. According to the preferred embodiment illustrated in FIG. 3, strips 24 are placed diagonally in an X-shaped configuration over the top and bottom surfaces of core 18. This configuration permits hull 10 to perform effectively in the manner of a torsion box, promoting controlled torsion flexibility particularly useful for maneuverability during water sports. Strips 24 are placed at an angle 30 to each other, which angle 30 may be varied from 0 to 90 degrees to achieve different magnitudes of torsional flexibility. When angle 30 is 0 degrees, strips 24 are parallel to one another and hull 10 exhibits maximum torsional flex and minimum longitudinal flex. As angle 30 approaches 90 degrees, hull 10 exhibits relatively less torsional flex and more longitudinal flex.

Whereas the embodiment shown in FIG. 3 depicts four strips 24 wrapped diagonally in an X-shaped configuration around core 18, other skeletal configurations for the placement of reinforcing strips 24 and the use of any number of strips 24 are within the scope of the present invention.

The thickness of core 18, and the extent and manner of its reinforcement with composite skin 22 and strips 24, can be varied to accommodate the size of the user and the board's intended use. For example, the combination of a thicker core 18 and thicker composite skin 22 with numerous reinforcing strips 24 results in a less flexible hull 10 allowing a heavier rider to achieve the performance of a lighter rider on a more flexible board. A less flexible hull 10 is also appropriate for those water sports involving greater forces, such as board sailing and big wave surfing. A more flexible hull 10, achieved by a thinner core 18 having relatively less reinforcement, is appropriate for those water sports where maneuverability with minimum effort is desired, such as body boarding and small wave surfing.

Figure 4A:
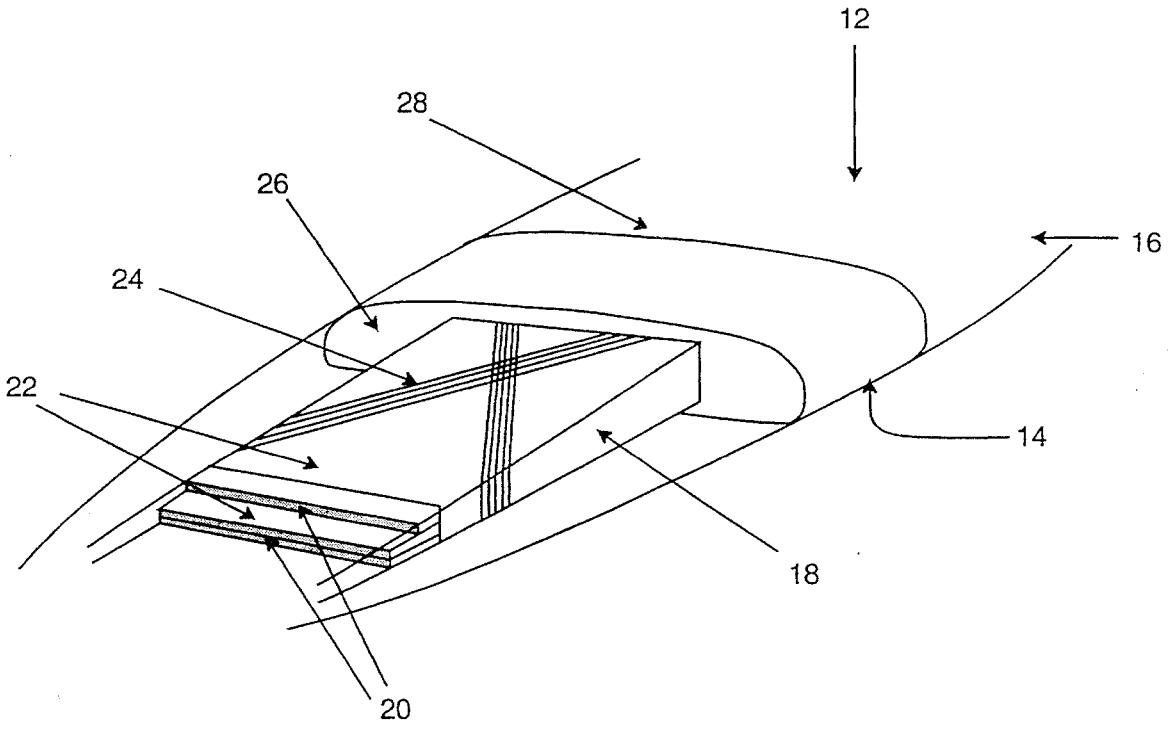
FIGS. 4A and 4B are partial perspective views of the improved water sports board with parts broken away showing alternative high strength cores.

For even greater strength and rigidity, core 18 is composed of core material 20 and composite skin 22 layered in a sandwich configuration as depicted in FIG. 4A. Alternatively, core 18 may be reinforced using stringers 32 as depicted in FIG. 4B.

Figure 4B:
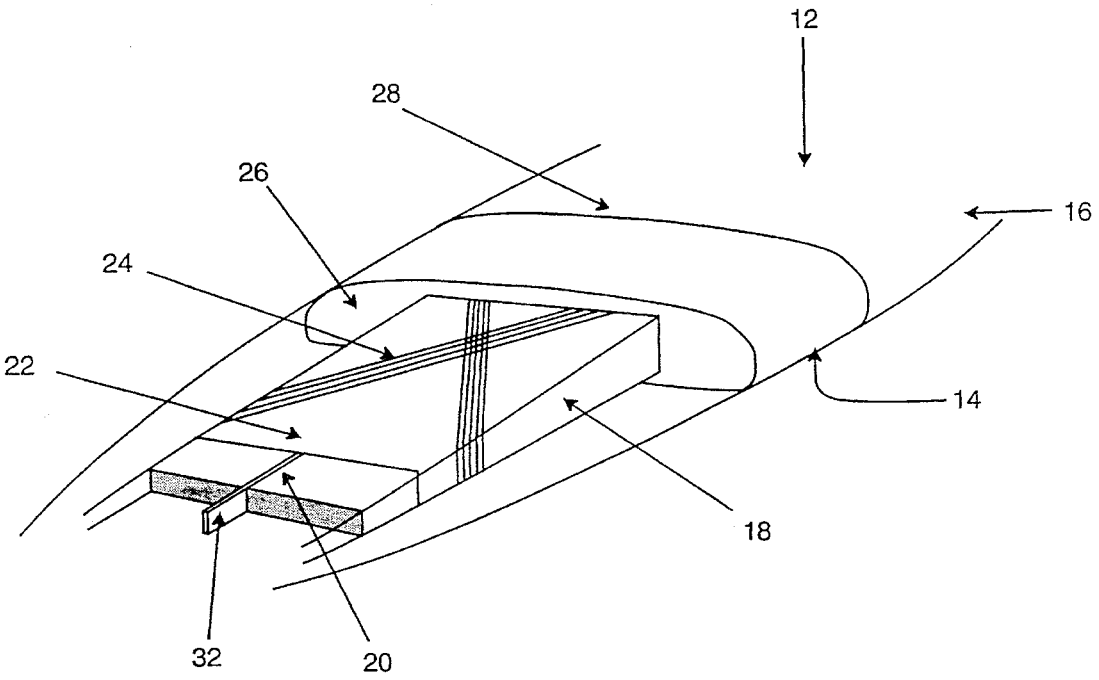

Although the use of reinforcing strips 24, sandwich configuration, and stringers 32 are separately illustrated in FIGS. 3, 4A, and 4B, respectively, it should be appreciated that these strengthening and stiffening techniques can be used together and in any combination.

The distribution of exterior layer 26 about composite skin 22 is varied to achieve buoyancy, performance and safety. Because layer 26 is composed of low density foam, a thicker exterior layer 26 causes hull 10 to be more buoyant. The overall shape of layer 26 prescribes the outside form of hull 10 which affects performance and maneuverability. The board illustrated in FIG. 2, for example, demonstrates layer 26 being relatively thicker at the nose 34 and relatively thinner along hull 10's aft bottom surface 14. The additional foam at nose 34 makes the board safer and more durable. The thinner foam layer along the rear section of bottom surface 14 promotes board performance. Thick sections of layer 26 further enhance the flexible and resilient character of hull 10.

Accordingly, whereas the relative dimensions and construction of core 18 is varied to achieve different degrees and directions of flexibility in hull 10, the shape and thickness of exterior layer 26 is varied to promote board performance, maneuverability, and safety.

Figure 5A:
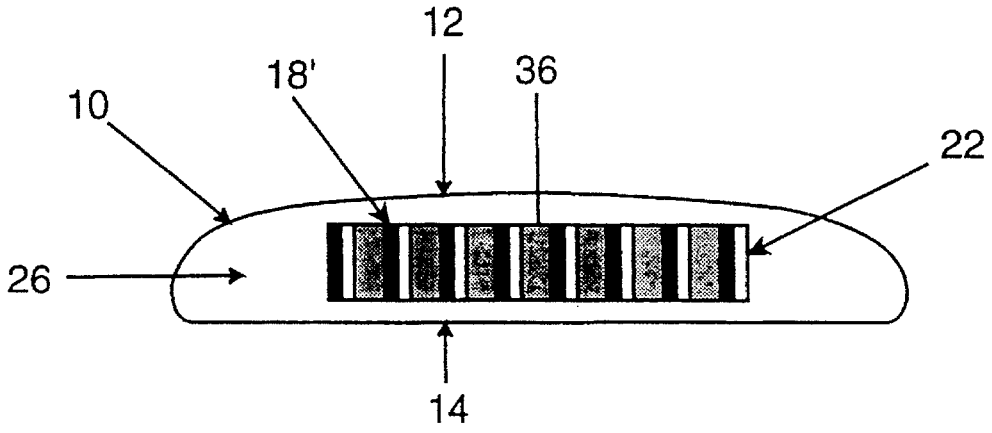
FIGS. 5A and 5B are lateral cross-sectional views of the improved water sports board, taken on line 5—5 of FIG. 1, with honey-comb and gas-filled cores, respectively.
Figure 5B:
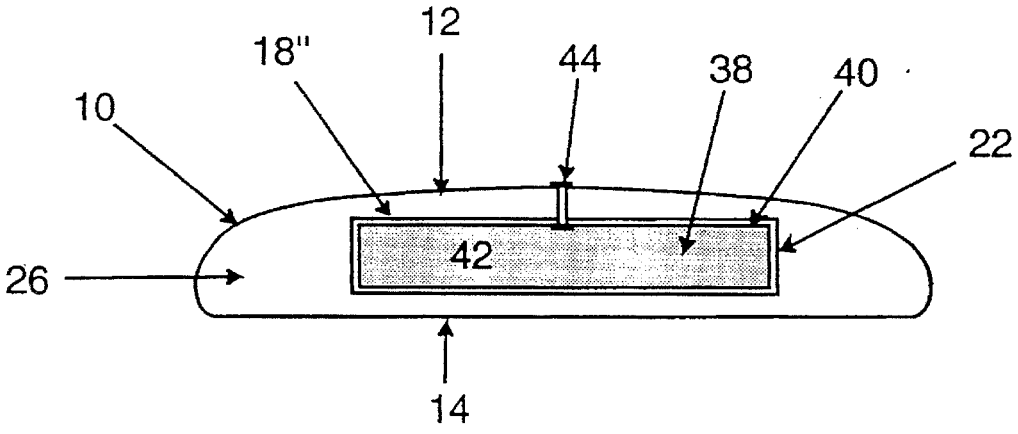

FIGS. 5A and 5B, lateral cross-sections taken on line 5—5 of FIG. 1, depict further preferred embodiments exhibiting specialized cores 18' and 18". FIG. 5A shows core 18' filled with a high-strength low density material 36 exhibiting a honey-comb architecture. FIG. 5B illustrates core 18" comprising a chamber 38 formed from a bladder 40 covered by skin 22 filled with a low density gas 42 under pressure. Bladder 40 may be constructed of lightweight rubber or plastic, and can be fitted with valves 44 traversing skin 22 through which the gas 42 is pumped and then sealed. Gas 42 may be helium gas or other low density, non-flammable gas.

According to the embodiment illustrated in FIG. 5B, low density gas 42 partially displaces the weight of hull 10 and its rider. When compressed and under pressure, gas 42 assists in maintaining the structural integrity and form of hull 10 during water sports activities and over multiple uses.

Figure 6A:
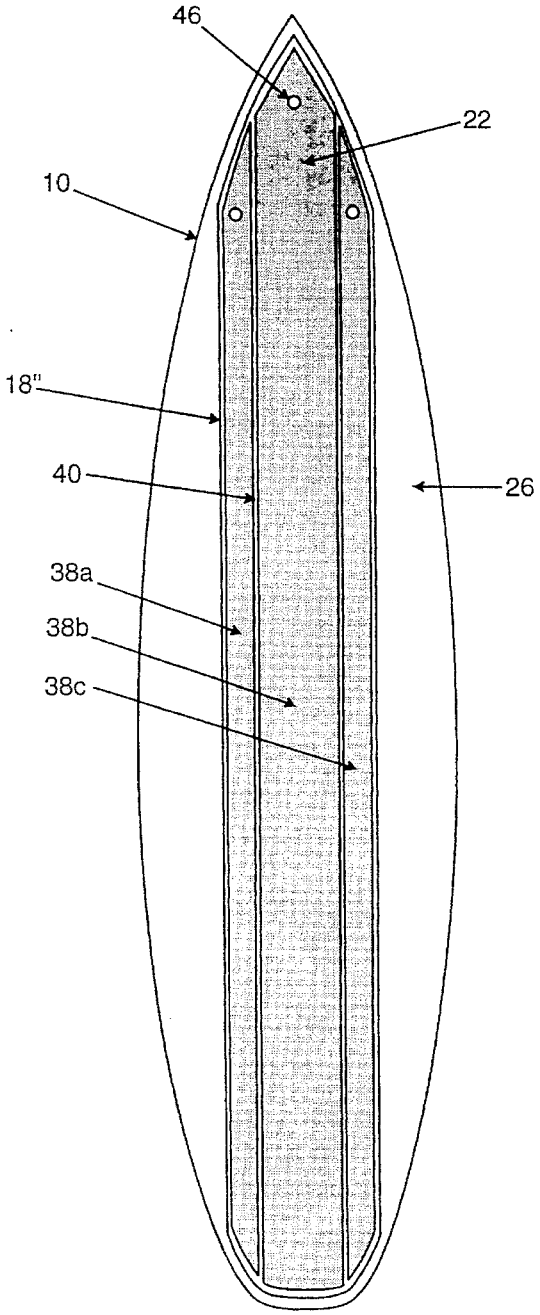
FIGS. 6A and 6B are longitudinal cross-sectional top views of the improved water sports boards, taken on line 6—6 of FIG. 2, showing alternative gas-filled embodiments.
Figure 6B:
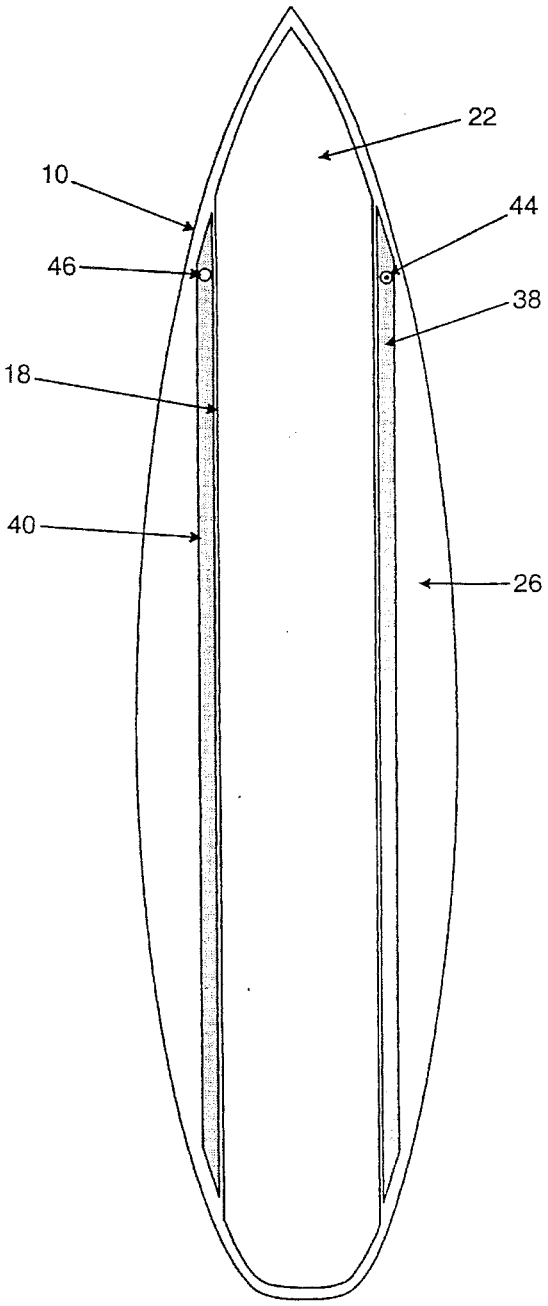

Alternative embodiments of the improved water sports board having gas filled chambers are depicted in FIGS. 6A and 6B, longitudinal cross-sectional top views taken on line 6—6 of FIG. 2. According to the embodiment shown in FIG. 6A, core 18" comprises three gas filled chambers 38*a*, 38*b*, and 38*c*, running the length of hull 10 and covered by skin 22. Each chamber 38 is formed by bladder 40 and each bladder 40 is fitted with a combination valve/thumb activated pump 46 which traverses skin 22. A user, while operating the board during water sports activities, can increase or decrease the pressure of gas 42 selectively among chambers 38*a*, 38*b*, and 38*c*, in order to achieve selective stiffness and flexibility in different sections of hull 10. Boards exhibiting asymmetric stiffness and flexibility are highly desirable, for example to accommodate prevailing wind or wave conditions, and because turns towards to the wave face tend to have longer turning radii than cutbacks (turns away from the wave face).

The preferred embodiment illustrated in FIG. 6B has gas filled chambers exterior to composite skin 22. According to this embodiment, two elongated tube shaped chambers 38 form right and left rails 16 of hull 10. Chambers 38 are adhered to skin 22 and embedded within exterior layer 26. Like the chambers described in previous embodiments, chambers 38 are formed from bladders 40 filled with compressed gas 42. Chambers 38 can similarly be fitted with valves 44, or valve/thumb activity pumps 46, allowing the pressure of gas 42 in chambers 38 to be selectively varied. According to this embodiment, core 18 may be comprised of any of the core materials 20 previously described.

The shape and configuration of chambers 38 may be varied, as may their number, to achieve different patterns of selective stiffness and flexibility in hull 10. Though not specifically illustrated herein, such alternative embodiments are within the scope of the present invention.

Figure 7:
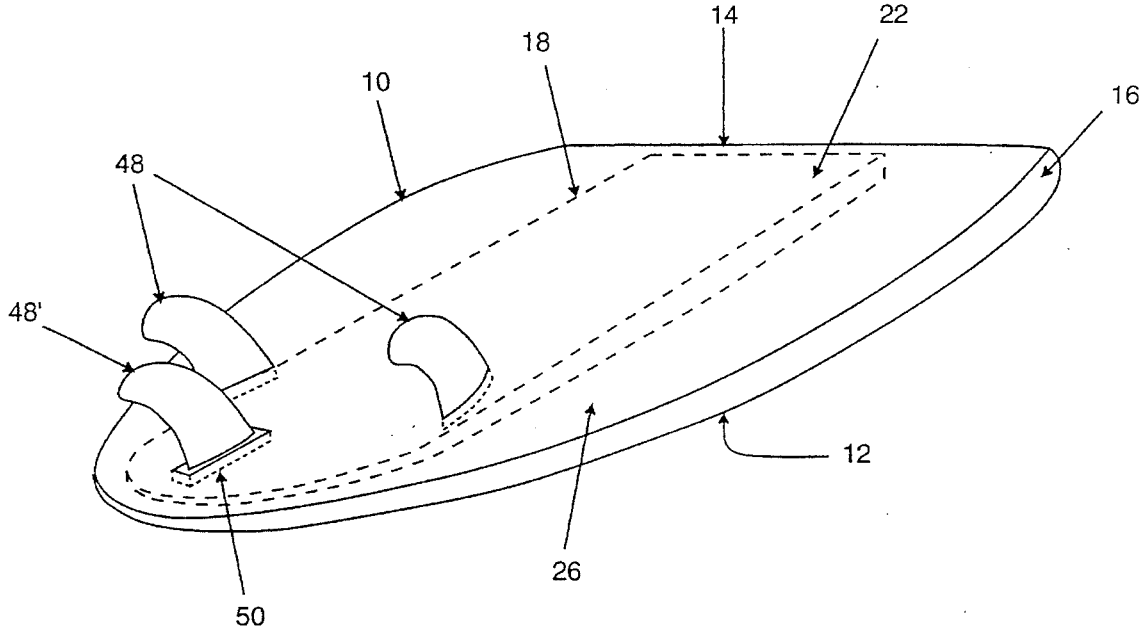
FIG. 7 is a partial perspective view of the bottom aft of an improved water sports board as a surfboard fitted with fins and fin box.

A typical embodiment of the improved water sports board as a surfboard is shown in FIG. 7. Extending from bottom surface 14 of hull 10 are fins 48 and 48'. The base of fins 48 are affixed to skin 22. The base of fin 48' is slideably mounted in a fin box 50. Fin box 50 is built into or formed as part of skin 22. According to this embodiment, exterior layer 26 is formed continuous with the base of fins 48 and covers skin 22 up to but not over the opening of fin box 50. Although not shown, it is understood that hull 10 can be equipped with any number and arrangements of fins and fix boxes.

Figure 8:
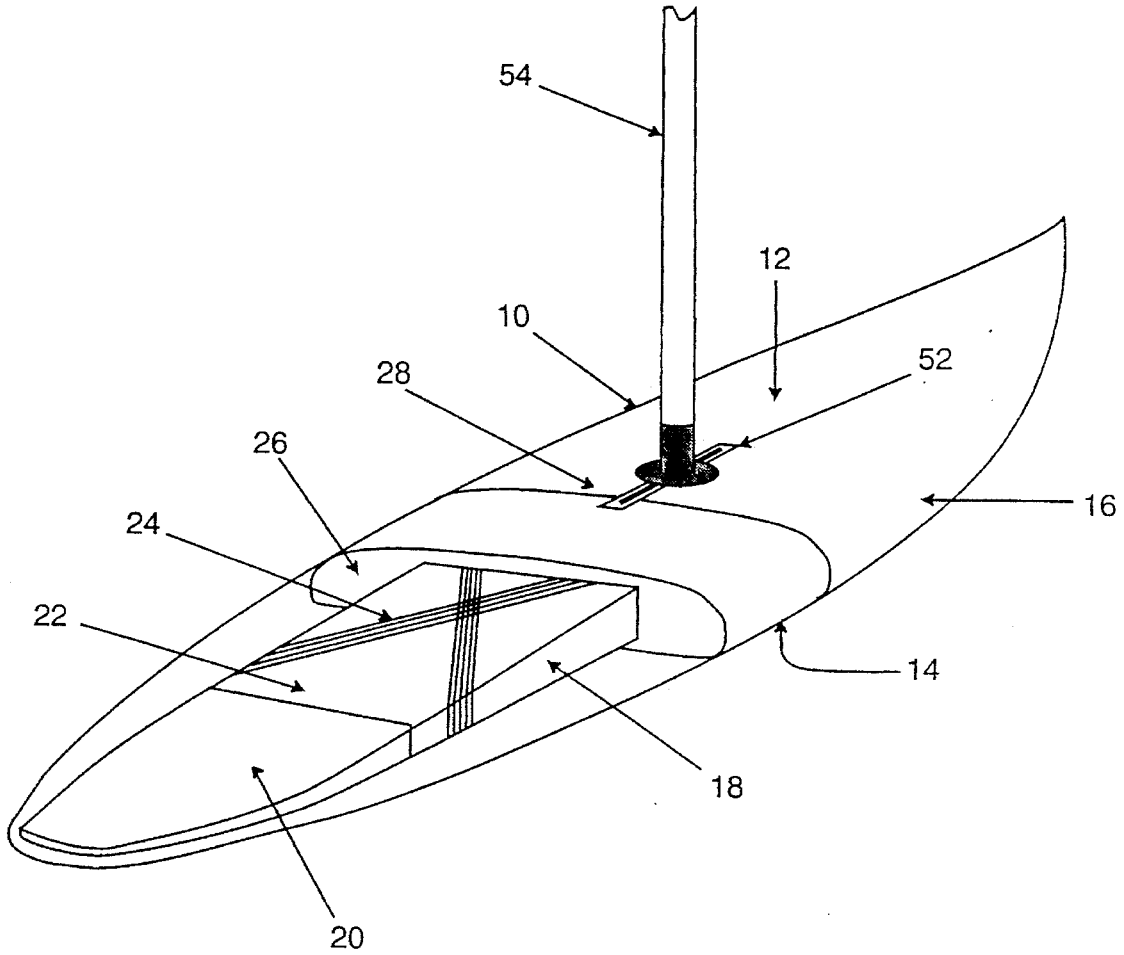
FIG. 8 is an perspective view of the improved water sports board as a sail board fitted with a mast track and mast.

A typical embodiment of the improved water sports board as a sail board is depicted in FIG. 8. Built into top surface 12 of skin 22 is a mast track 52, into which is slideably mounted mast 54. Exterior layer 26 is formed to leave mast track 52 exposed to receive mast 54. Although not shown, a mast step or other means for flexibly attaching mast 54 to hull 10 can be substituted for the mast track 52 illustrated in FIG. 8.

SUMMARY AND SCOPE

Thus, as is readily seen, the elongated substantially box-shaped low density high strength composite core 18 provides a high performance water sports board that is light and durable and which exhibits controlled flexibility and resilience. The combinations of low density and controlled flexion provides the rider with maximum maneuverability. Reinforcing strips 24 placed over skin 22 according to specific configurations further strengthens the board and constrains the board's controlled flexion to directions particularly suited to given water sports. The soft exterior layer 26 covering skin 22 renders the board comfortable to ride and safer to use, and the contoured shape of layer 26 enhances the board's performance. Gas filled chambers 38, equipped with valves 44 or valve/pumps 46, enables the user to selectively vary the board's stiffness and flexibility before or during use.

Although the present invention has been described and illustrated in connection with a number of preferred embodiments, it is understood that modifications and variations may be resorted to without departing from the spirit of the invention, as those skilled in the art will readily understand. Such modifications and variations are considered to be within the purview and scope of the present invention as defined in the appended claims and their legal equivalents.

The embodiments of the invention which an exclusive property or privilege is claimed are defined as follows:

1. A water sports board, comprising:

(a) an elongated core, substantially rectangular in plan shape and cross section, tapering forward and aft, composed of a low density fill material enclosed within a high strength composite skin;

(b) a contoured exterior layer formed of low density soft resilient non-permeable material adhered to and surrounding said high strength composite encapsulating said elongated core;

(c) said core having a shape, relative thickness, and composition which combine to allow a degree of longitudinal and torsional flexibility sufficient to vary the board curvature under load and promote board maneuverability;

(d) said exterior lawyer having a shape and composition which combine to promote board flotation, performance, and flexion control.

2. A water sports board according to claim 1 wherein said contoured exterior layer is coated with a smooth film.

3. A water sports board according to claim 1 wherein said soft resilient non-permeable material which forms said contoured exterior layer is selected from a group consisting of polyethylene foam and polypropylene foam.

4. A water sports board according to claim 1 wherein said low density fill material is selected from a group consisting of extruded polystyrene foam, expanded polystyrene foam beads, polyurethane foam, and rigid polyvinylchloride foam.

5. A water sports board according to claim 1 wherein said high strength composite skin is further comprised of a resin/fiber matrix.

6. A water sports board according to claim 5 wherein the resin in said resin/fiber matrix ie selected from a group consisting of epoxy, polyester and vinylester resins, and the fiber in said resin/fiber matrix is selected from a group consisting of glass, carbon, boron carbide, beryllium, and polymeric fibers.

7. A water sports board according to claim 1 further comprising strips of composite tape placed in specific configurations on the top and bottom surfaces of said elongated core to reinforce said core and to restrict the flexion of said core along particular axes.

8. A water sports board according to claim 7 wherein said reinforcing strips are placed diagonally in an X-shaped configuration along the top and bottom surfaces and sides of said core to promote controlled twist and torsion flexibility in said elongated core.

9. A water sports board according to claim 7 wherein said reinforcing strips are tape selected from the group consisting of carbon tape and carbon/glass tape.

10. A water sports board according to claim 1 wherein said low density fill material is configured in a honey-comb lattice for added strength.

11. A water sports board according to claim 1 wherein said low density fill material is layered with high strength composite resin/fiber matrix in a sandwich configuration for added strength.

12. A water sports board according to claim 1 further comprising fins affixed onto and extending outward from said elongated core traversing said contoured exterior layer.

13. A water sports board according to claim 1 further comprising a fin box built into said elongated core wherein said contoured exterior layer is formed to leave the fin box exposed to receive the fin.

14. A water sports board according to claim 1 further comprising a mast track built into said elongated core wherein said contoured exterior layer is formed to leave the mast track exposed to receive the mast.

15. A water sports board comprising:

(a) an elongated core, substantially rectangular in plan shape and cross section, tapering forward and aft, composed of a low density fill material enclosed within a high strength composite skin;

(b) a contoured exterior layer formed of low density soft resilient non-permeable material adhered to and encapsulating said elongated core;

(c) said core having a shape, relative thickness, and composition which combine to allow a degree of longitudinal and torsional flexibility sufficient to vary the board curvature under load and promote board maneuverability;

(d) said exterior layer having a shape and composition which combine to promote board flotation, performance, and flexion control, wherein said elongated core is strengthened using stringers.

16. A water sports board comprising:

(a) an elongated core, substantially rectangular in plan shape and cross section, tapering forward and aft, composed of a low density fill material enclosed within a high strength composite skin;

(b) a contoured exterior layer formed of low density soft resilient non-permeable material adhered to and encapsulating said elongated core;

(c) said core having a shape, relative thickness, and composition which combine to allow a degree of longitudinal and torsional flexibility sufficient to vary the board curvature under load and promote board maneuverability;

(d) said exterior layer having a shape and composition which combine to promote board flotation, performance, and flexion control, wherein said low density fill material comprises a bladder filled with a low density non-flammable gas under pressure.

17. A water sports board according to claim 16 wherein said pressurized gas is helium gas.

18. A water sports board according to claim 16 wherein said bladder is equipped with a means for varying the pressure of the gas prior to and while said board is in use.

19. A water sports board according to claim 16 wherein said low density fill material comprises a plurality of longitudinally oriented bladders filled with low density non-flammable gas under pressure.

20. A water sports board according to claim 19 wherein said bladders are equipped with a means for selectively varying the pressure of the gas in each bladder prior to and while the board is in use.

21. A water sports board comprising:

(a) an elongated core, substantially rectangular in plan shape and cross section, tapering forward and aft, composed of a low density fill material enclosed within a high strength composite skin;

(b) a contoured exterior layer formed of low density soft resilient non-permeable material adhered to and encapsulating said elongated core;

(c) said core having a shape, relative thickness, and composition which combine to allow a degree of longitudinal and torsional flexibility sufficient to vary the board curvature under load and promote board maneuverability;

(d) said exterior layer having a shape and composition which combine to promote board flotation, performance, and flexion control, and further longitudinally oriented bladders filled with a light weight non-flammable gas under pressure affixed along each edge of said elongated core and embedded within said exterior layer formed of soft resilient non-permeable material.

22. A water sports board according to claim 21 wherein said bladders are equipped with a means for selectively varying the pressure of the gas in each bladder prior to and while said board is in use.

* * * * *